US007711281B2

(12) United States Patent
Hamano et al.

(10) Patent No.: US 7,711,281 B2
(45) Date of Patent: May 4, 2010

(54) IMAGE FORMING APPARATUS FOR EXECUTING ADJUSTMENT PROCESSING AND FINISHING PROCESSING

(75) Inventors: Shigemichi Hamano, Abiko (JP); Junichi Noguchi, Suzhou (CN); Takashi Kanno, Kashiwa (JP); Takashi Soya, Abiko (JP); Shinichi Takata, Abiko (JP); Kiyoshi Okamoto, Moriya (JP); Katsuyuki Yamazaki, Toride (JP); Tomoichiro Ohta, Kashiwa (JP)

(73) Assignee: Canon Kabushiki Kaisha (JP)

( * ) Notice: Subject to any disclaimer, the term of this patent is extended or adjusted under 35 U.S.C. 154(b) by 715 days.

(21) Appl. No.: 11/464,601

(22) Filed: Aug. 15, 2006

(65) Prior Publication Data

US 2007/0036575 A1 Feb. 15, 2007

(30) Foreign Application Priority Data

Aug. 15, 2005 (JP) ..... 2005-235484

(51) Int. Cl.
*G03G 15/00* (2006.01)

(52) U.S. Cl. ..... 399/82; 399/43; 399/407

(58) Field of Classification Search ..... 399/38, 399/43, 49, 66, 71, 82, 127, 407; 358/1.12, 358/296, 300

See application file for complete search history.

(56) References Cited

U.S. PATENT DOCUMENTS

| | | | | |
|---|---|---|---|---|
| 5,159,395 | A * | 10/1992 | Farrell et al. | 399/401 |
| 6,226,471 | B1 * | 5/2001 | Tsuzuki | 399/75 |
| 6,384,934 | B1 | 5/2002 | Hideto et al. | |
| 6,519,425 | B2 * | 2/2003 | Fischer | 399/49 |
| 2003/0156851 | A1 * | 8/2003 | Koh et al. | 399/45 |

FOREIGN PATENT DOCUMENTS

JP 2004-145083 A 5/2004

* cited by examiner

*Primary Examiner*—David P Porta
*Assistant Examiner*—Benjamin Schmitt
(74) *Attorney, Agent, or Firm*—Rossi, Kimms & McDowell LLP

(57) ABSTRACT

A technique for reducing downtime that accompanies the execution independently of adjustment processing for maintaining image quality and the execution of finishing processing relating to a printing medium. In order to apply the finishing processing to the printing medium in a finishing processing unit, an image forming apparatus to which this technique is applied sets a time between sheets that extends from end of image formation regarding a first sheet of the printing medium to start of image formation regarding a second sheet of the printing medium transported following the first sheet of the printing medium in the image forming unit, and executes adjustment processing, which is for maintaining image quality in the image forming unit, within the set time between sheets.

3 Claims, 11 Drawing Sheets

IMAGE FORMING APPARATUS FOR EXECUTING ADJUSTMENT PROCESSING AND FINISHING PROCESSING

BACKGROUND OF THE INVENTION

1. Field of the Invention

This invention relates to an image forming apparatus having an adjusting function for maintaining image quality, and to a method of controlling this apparatus.

2. Description of the Related Art

In order to maintain image quality in an image forming apparatus, the conventional practice is to execute adjustment processing (also referred to as "maintenance control") automatically during image formation.

The specification of U.S. Pat. No. 6,384,934 proposes suppressing the adjustment of image processing conditions, even when such adjustment becomes necessary, until the image processing job currently being executed ends.

The specification of U.S. Pat. No. 6,384,934 further proposes inhibiting the execution of other image processing jobs, with the exception of the image processing job currently being executed, until adjustment ends if adjustment of image processing conditions becomes necessary. These proposals represent extremely desirable techniques in terms of maintaining image quality.

In order to meet various demands for large-volume printing and the like, a variety of finishing processes such as those that use a finisher or the like have been proposed. In the specification of Japanese Patent Application Laid-Open No. 2004-145083, a batch discharge process, staple binding process, folding process and bookbinding process listed as examples of sheet finishing processes in a finishing processing units.

The invention set forth in the specification of U.S. Pat. No. 6,384,934 is an outstanding invention for the purpose of maintaining image quality. If correction processing is executed, however, it is difficult to avoid the occurrence of downtime. Even though maintenance of a high image quality is the objective, the occurrence of downtime would be undesirable for an operator who wants no delay.

There has been a tendency in recent years to reduce the number of parts in an image forming apparatus in order to lower cost. Generally, when the number of parts is reduced, there tends to be a decline in the stability of image quality. Although it is necessary to increase the number of times adjustment processing is executed in order to maintain image quality, downtime also increases.

In addition, downtime is brought about even by the finishing processes mentioned above. Since the conventional practice is to execute an adjustment process and a sheet finishing process at respective timings that are not related to each other, there is a further increase in downtime.

SUMMARY OF THE INVENTION

A feature of the present invention is to provide an image forming apparatus for executing adjustment processing, which is for maintaining image quality, in an image forming unit in concurrence with execution of finishing processing relating to a printing medium in a finishing processing unit.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will now be described in detail in accordance with the accompanying drawings.

Figure 1:
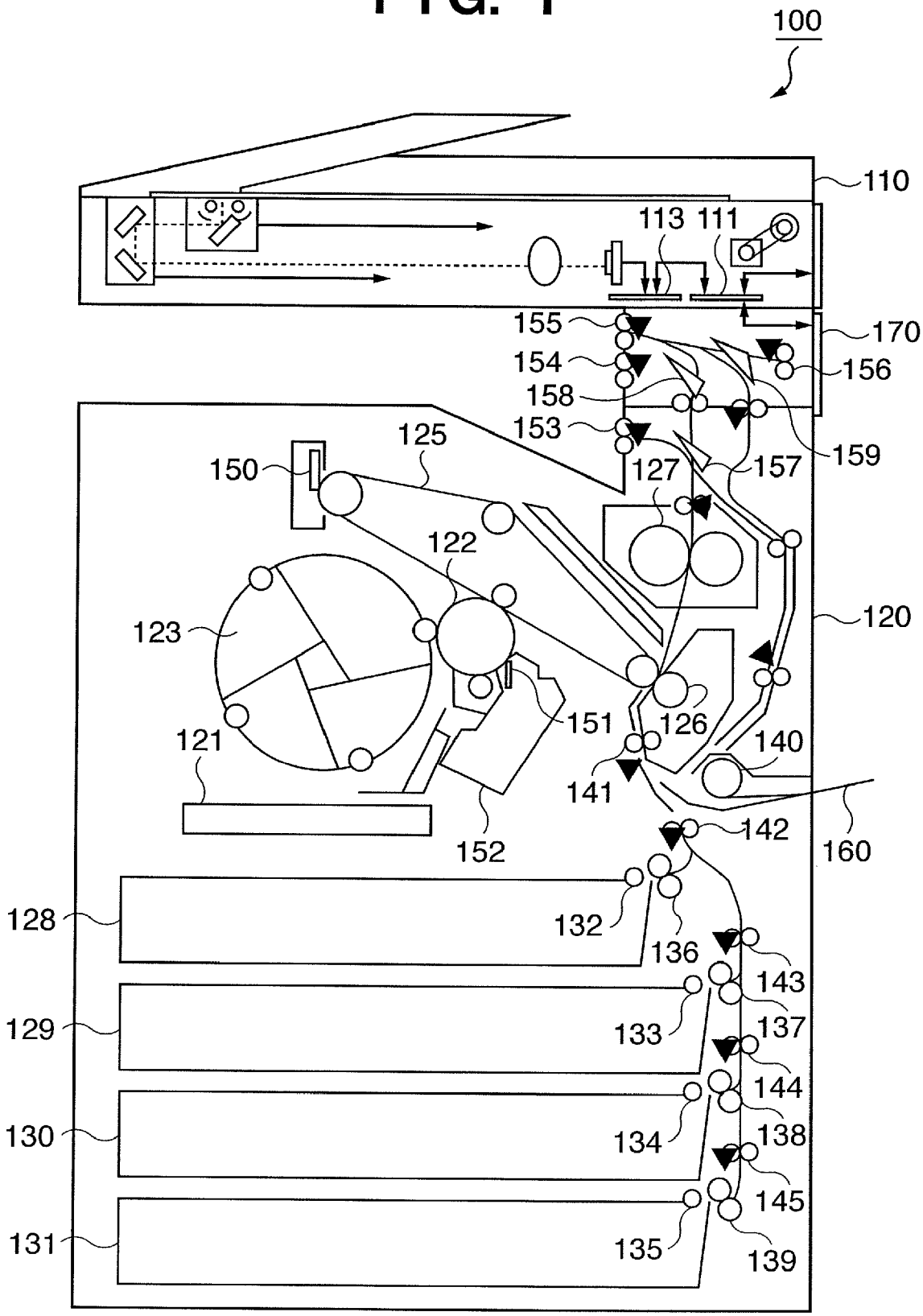
FIG. 1 is a diagram illustrating the general structure of an image forming apparatus according to an embodiment of the present invention.

FIG. 1 is a diagram illustrating the general structure of an image forming apparatus 100 according to an embodiment of the present invention. The image forming apparatus 100 primarily comprises a reader 110 and an image forming unit 120.

The reader 110 includes an optical device for reading the image of an original. A controller 111 is a unit for controlling each component of the reader 110. A digital image processor 113 is a unit for converting the image of the original, which has been read by an image sensor, to digital data. Other components of the reader 110 are well known and need not be described again.

The image forming unit 120 performs the operation described below based upon a control signal from a printer controller 170. A laser scanner 121 irradiates a photosensitive drum 122 with a laser beam that conforms to image data. An electrostatic image that has been formed on the photosensitive drum 122 is developed by a developing unit 123 for each color. That is, a toner image is formed on the photosensitive drum 122. The toner image that has been formed on the photosensitive drum 122 is transferred to an intermediate transfer medium 125, which rotates in the counter-clockwise direction, by rotation of the photosensitive drum 122 in the clockwise direction. (This represents primary transfer.)

A printing medium (e.g., printing paper) held in first, second, third and fourth cassettes 128, 129, 130 and 131, respectively, is picked up by corresponding pick-up rollers 132, 133, 134 and 135. The printing paper picked up is transported to corresponding feed rollers 136, 137, 138 and 139, respectively. The printing paper is further transported to a registration roller 141 by vertical-path transport rollers 142, 143, 144 and 145. In a case where paper is inserted manually, printing paper that has been stacked in a manual-insertion tray is transported to the registration roller 141 by a manual-insertion feed roller 140.

The printing paper is transported to a point between the intermediate transfer medium 125 and a secondary transfer roller 126 in conformity with the timing at which transfer of the toner image to the intermediate transfer medium 125 ends. The printing paper thenceforth undergoes secondary transfer of the toner image on the intermediate transfer medium 125 while the paper is being transported toward a fixing unit. The toner image that has been transferred to the printing paper is subjected to heat and pressure and fixed to the printing paper by a fixing roller and pressurizing roller 127.

A cleaning blade 150 wipes off residual transferred toner remaining on the intermediate transfer medium 125 without being transferred to the printing paper. The cleaning blade 150 can be brought into and out of contact with the surface of the intermediate transfer medium 125. Cleaning is executed by post-rotation control in the latter half of the image forming sequence.

A cleaning blade 151 wipes off residual toner on the photosensitive drum 122. The toner that has been wiped off accumulates in a waste-toner box 152. Furthermore, the cleaning blade 150 wipes off residual toner that might possibly be adsorbed onto the secondary transfer roller 126 unexpectedly. Thus, residual toner is wiped off completely and post-rotation control ends.

The printing paper to which the image has been fixed is discharged by a first discharge mode, second discharge mode or third discharge mode. In the case of the first discharge mode, the printing paper is guided by a first discharge flapper 157, directed toward a discharge roller 153 and discharged. In the case of the second discharge mode, the printing paper is guided by the first discharge flapper 157 and a second discharge flapper 158, directed toward a discharge roller 154 and discharged. In the case of the third discharge mode, an operation for turning over the printing paper temporarily by a reversing roller 155 is required. To achieve this, the first discharge flapper 157 and second discharge flapper 158 are switched over in the direction of the reversing roller 155. The printing paper is thenceforth guided by a third discharge flapper 159, directed to a third discharge roller 156 and discharged.

In case of double-sided discharge, the printing paper is turned over temporarily by the reversing roller 155. The third discharge flapper 159 is then switched in toward the direction of a double-side unit, whereby the printing paper is transported to the double-side unit. After the printing paper is sensed by a double-side sensor, transport of the printing paper is halted until a prescribed period of time elapses. Upon completion of preparations for image formation again, the printing paper is fed again and image formation on the second side of the paper is performed.

[Adjustment Processing Performed During Execution of Image Forming Job]

The image forming unit 120 generally executes various adjustment processing at various timings while an image forming job is in progress. For example, there is adjustment processing for maintaining a high image quality, and adjustment processing for maintaining the durability of the various parts that construct the image forming unit 120. It should be noted that in a broad sense, the latter adjustment processing also is adjustment processing for maintaining image quality.

More specifically, patch detection ATR (Automatic Toner Regulation) control for implementing stabilized toner density is available. Also available are primary-transfer ATVC (Automatic Transfer Voltage Control) and secondary-transfer ATVC, which determine a transfer voltage for implementing optimum transfer. Also available is black band control for preventing "blade curl-up", which occurs owing to an increase in friction between the cleaning blade 150 and the surface of the intermediate transfer medium 125. Typical adjustment processing will now be described in simple terms.

[Patch Detection ATR Control]

In this adjustment processing, a toner pattern (patch) of a prescribed density is formed on the photosensitive drum 122 and the density of this toner pattern is detected by a patch detector (not shown). The density detected and an optimum target density at this time are compared. The target density generally is decided based upon the state of toner replenishment or the ratio between toner and carrier.

If the detected patch density is higher than the target density, the amount of toner replenishment is adjusted so as to lower the toner density. For example, the amount of toner replenishment of the pertinent color is reduced. If the density detected is lower than the target density, on the other hand, then the amount of toner replenishment is adjusted so as to raise the toner density. In other words, the amount of toner replenishment of the pertinent color is increased.

[Primary-Transfer ATVC/Secondary-Transfer ATVC]

In accordance with this embodiment, primary transfer and second transfer are performed in the manner described above. Transfer voltage set when this transfer is carried out is influenced by the surrounding environment of the image forming unit 120 and number of toner colors. Furthermore, in secondary transfer, transfer voltage is affected greatly by resistance on the paper side when transfer to the printing paper is performed. For example, thick paper requires a higher transfer voltage than ordinary paper.

Accordingly, in order to decide the optimum transfer voltage, it is necessary to acquire the relationship between transfer voltage and current in the surrounding environment. For example, the relationship between transfer voltage and current can be acquired by sampling current values at a number of points while changing the set voltage. It should be noted that control when a current value for primary transfer is sampled is referred to as "primary-transfer ATVC". Further, control when a current value for secondary transfer is sampled is referred to as "secondary-transfer ATVC".

[Black Band Control]

The cleaning blade 150 for the intermediate transfer medium 125 and the cleaning blade 151 for the photosensitive drum 122 may curl up or tear. One technique for preventing such damage is black band control. One cause of damage relating to the cleaning blade 150 is an increase in friction between the intermediate transfer medium 125 and cleaning blade 150, which causes the intermediate transfer medium 125 and cleaning blade 150 to stick together. Similarly, one cause of damage relating to the cleaning blade 151 for the photosensitive drum 122 is an increase in friction between the photosensitive drum 122 and blade 151.

Further, if foreign matter such as paper dust arises in a state of increased friction, part of the blade may become chipped. Black band control is effective in dealing with problems such as blade curl-up or chipping. Black band control is control that feeds toner (black toner), which serves as a lubricant, to the surfaces of contact between the intermediate transfer medium 125 and blade 150 or between the photosensitive drum 122 and blade 151. The lubricant suppresses friction and mitigates problems such as blade curl-up or chipping.

First, a band-like toner pattern (a black band) is formed on the entirety of the surface of the photosensitive drum 122 along the main-scan direction. The black band transferred completely from the photosensitive drum 122 to the intermediate transfer medium 125 is transported to the cleaning blade 150 for the intermediate transfer medium 125. It should be noted that if control is exercised in such a manner that the black band is not transferred completely from the photosensitive drum 122 to the intermediate transfer medium 125, the toner pattern remaining on the photosensitive drum 122 will become a black band for the cleaning blade 151 of the photosensitive drum. The amount of black band transferred can be adjusted by turning off a primary transfer bias or by applying a reverse bias.

[Relationship between Adjustment Processing and Space Between Sheets]

There are instances where processing time for the above-described adjustment processing is longer than the minimum time between sheets. The time between sheets refers to the period of time from the end of formation (primary transfer) regarding a certain image to the beginning of formation (transfer) regarding the next image. Alternatively, the time between sheets may be referred to as the length of time from the end of image formation on (transfer to) a certain sheet of printing paper to the beginning of image formation on (transfer to) the next sheet of printing paper. Further, the minimum time between sheets is referred to as the time between sheets that prevails when the image forming apparatus 100 is operated at peak throughput. Furthermore, distance between sheets refers to the distance (spacing) between the trailing edge of a certain image and the leading edge of the next image when images are formed one after another. The minimum distance between sheets refers to distance between sheets that prevails when the image forming apparatus 100 is operated at peak throughput.

Ordinarily, executing adjustment processing within the minimum time between sheets results is good efficiency. However, if the adjustment processing time is longer than the minimum time between sheets, then the time between sheets must be lengthened. For example, it may be so arranged that the following will hold: [time between sheets]=[minimum time between sheets]+$\alpha$($\alpha$ adjustment processing time).

Further, each type of adjustment processing described above preferably is executed at the respective optimum timing. However, if the adjustment processes are implemented at random timings, downtime will occur too frequently.

Accordingly, in an image forming system according to this embodiment, scheduling is performed in such a manner that a plurality of adjustment processes will be executed in parallel to the extent possible.

[Various Finishing Processes in Finishing Processing Unit]

Figure 2:
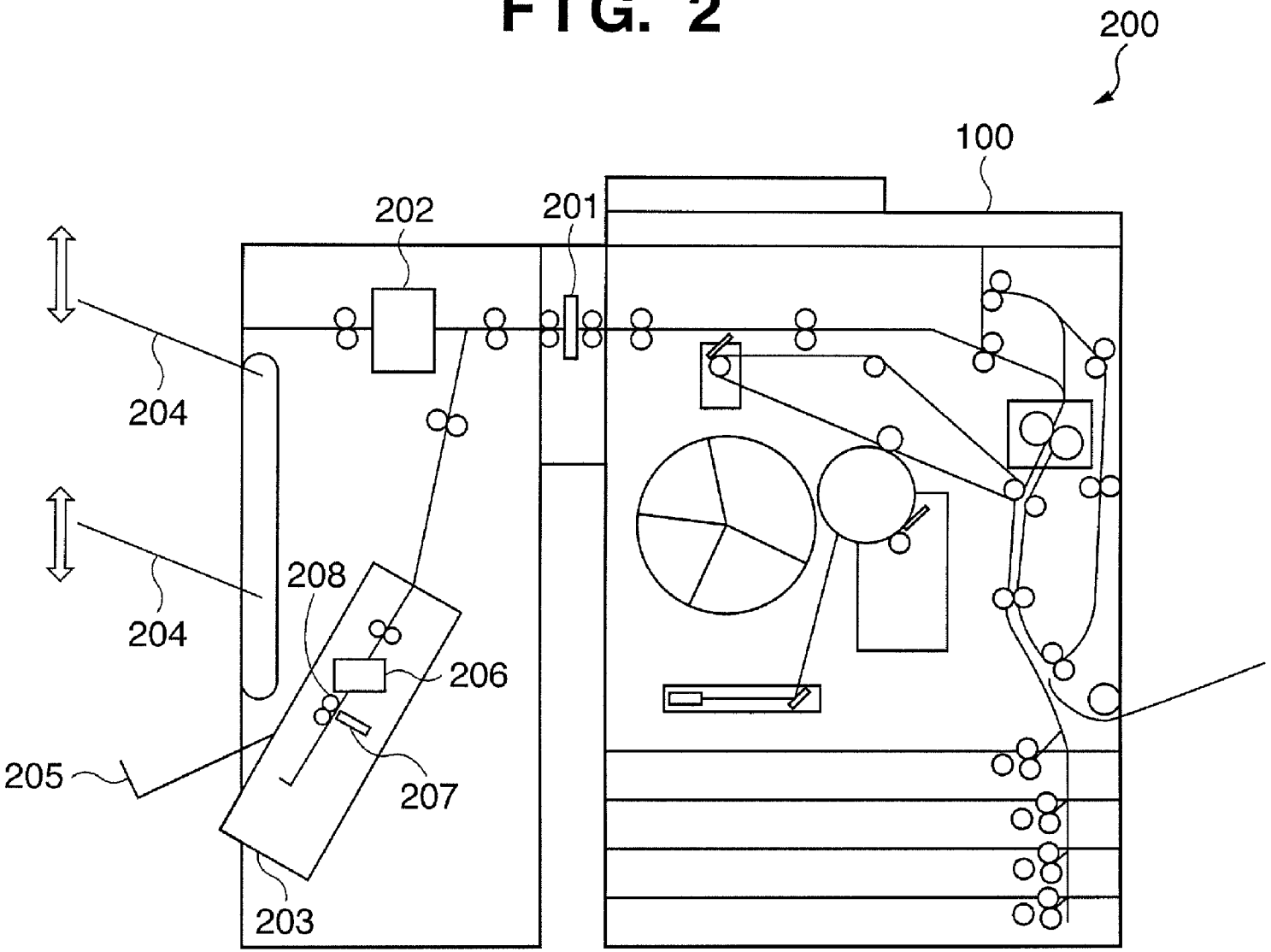
FIG. 2 is a diagram illustrating the general configuration of an image forming system that includes a finishing processing unit according to the embodiment.

FIG. 2 is a diagram illustrating the general configuration of an image forming system 200 that includes a finishing processing unit according to the embodiment. In accordance with the image forming system 200, finishing processing units 201 to 204 are connected directly or indirectly to the above-described image forming apparatus 100. The finishing processing unit 201 is a puncher for punching two or three holes in printing paper that is output from the image forming apparatus 100. A finishing processing unit 202 is a stapling device that bundles sheets of printing paper together, aligns them and staples them. A finishing processing unit 203 is a saddle device for folding the sheets of printing paper and outputting them after they have been stapled. A finishing processing unit 204 is a paper discharge tray onto which printing paper that has passed through the stapling device is discharged. A finishing processing unit 205 is a saddle paper discharge tray for discharging a batch of printing paper from the saddle device 203.

The puncher 201 causes printing paper, which has been output from the image forming apparatus 100, to stop reliably at a prescribed position and punches holes in the paper one sheet at a time. During the punching process, the puncher 201 generally cannot accept the next page of printing paper. If punching processing time is longer than the minimum time between sheets, it can become necessary to lengthen the time between sheets. It should be noted that if there is another puncher for punching holes during the transport of printing paper, then time for punching processing will be unnecessary.

The stapling device 202 performs stapling at either the upper or lower corner of the printing paper on the trailing-edge side thereof along the direction (main-scan direction) perpendicular to the direction in which the printing paper is transported, or at two prescribed locations on the trailing-edge side thereof along the main-scan direction. That is, the stapling position is decided in advance. In order to perform stapling at the precise location, the stapling unit must be moved to a prescribed position corresponding to the location after the sheets of printing paper in the batch are aligned. Accordingly, processing time for aligning the sheets of printing paper in the batch is necessary and so is processing time for moving the stapling unit. There are many cases where this processing time is longer than the above-mentioned minimum time between sheets. This means that if stapling processing is not executed, image formation can be performed in the minimum time between sheets, but if stapling processing is executed, then it can become necessary to lengthen the time between sheets.

In a case where bookbinding is performed by the saddle device 203, the saddle device 203 aligns the sheets of printing paper in the batch and thereafter a stapling unit 206 in the saddle device staples the batch of the sheets of printing paper. Furthermore, the saddle device 203 moves the stapled batch of printing paper to a folding position. In order to fold the stapled batch of printing paper at the center thereof, the saddle device 203 causes a mechanical abutting member 207 to strike the printing paper accurately at the center thereof and moves the mechanical abutting member 207 in the direction of the arrow. As a result, the batch of printing paper is pushed into a nip portion of folding rollers 208 so that the paper is folded in half. The batch of printing paper thus bound into the form of a book is discharged onto the saddle tray 205. Image formation can be performed in the minimum time between sheets up to the start of processing for stapling the batch of printing paper. However, image formation for the next page cannot be started until stapling processing is completed. When stapling processing starts, therefore, it can become necessary to lengthen the time between sheets.

[Parallel Execution of Various Finishing Processes and Various Adjustment Processes in Finishing Processing Unit]

As described above, the finishing processing units 202 to 204 basically treat one or more sheets of printing paper as one copy and execute finishing processing that has been designated in copy units. Image formation and paper transport are executed in the minimum time between sheets within one and the same copy. Accordingly, the interval between the copies of printing paper transported to the finishing processing units 202 to 204 becomes the timing at which finishing processing is executed. When finishing processing that cannot be executed in the minimum time between sheets is executed, the time between sheets between the final page of a certain copy and the first page of the next copy must be lengthened in accordance with the processing time required, as mentioned above. In order to lengthen the time between sheets, the image formation interval (paper feed interval) in the image formation apparatus must be adjusted.

Figure 3:
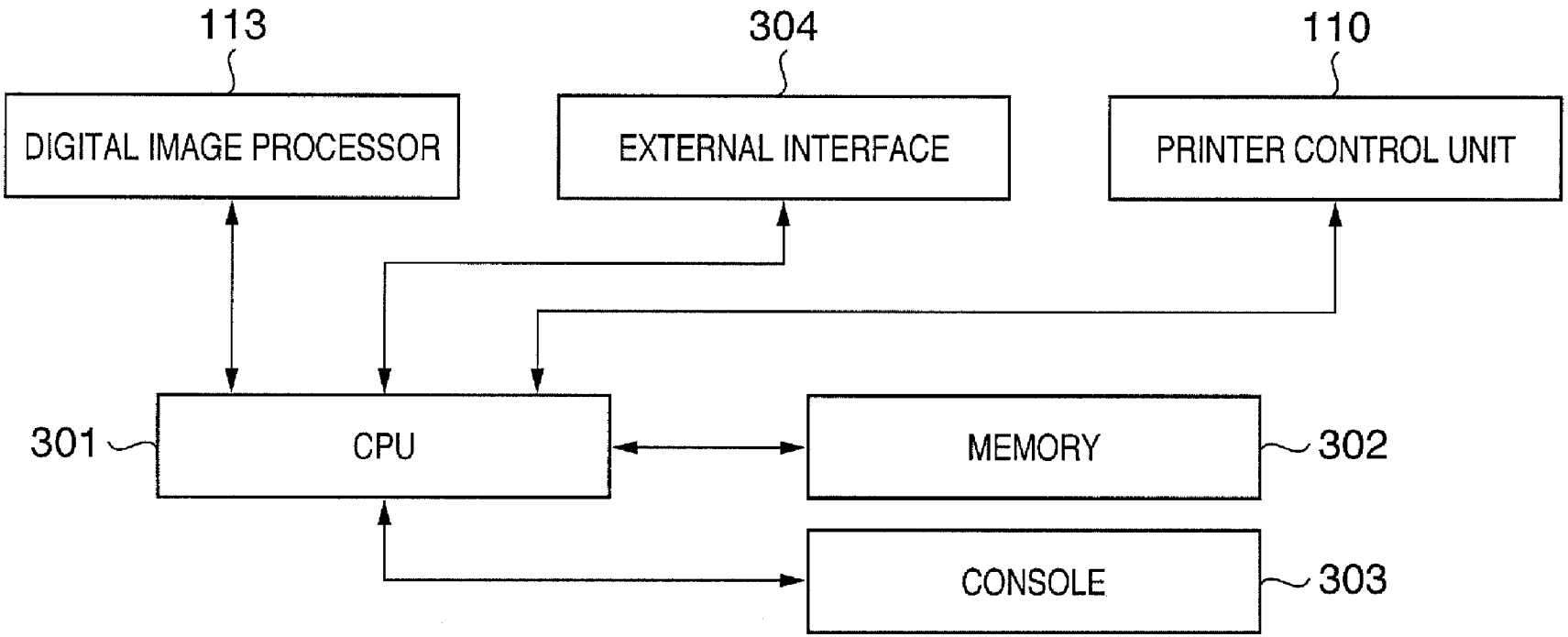
FIG. 3 is an exemplary block diagram illustrating a printer controller according to the embodiment.

FIG. 3 is an exemplary block diagram illustrating a printer controller according to the embodiment. The printer controller 170 comprises a CPU 301, a memory 302, a console 303 and an external interface 304. The CPU 301 controls image formation processing, adjustment processing and finishing processing, etc., based upon a program that has been stored in the memory 302, etc. The memory 302, which is constituted by a RAM or ROM, etc., stores required information. The console 303 is a liquid crystal device with a touch-sensitive panel for allowing the operator to specify processing and for displaying various information for viewing by the operator. The external interface 304 is a communication circuit for communicating with the finishing processing units mentioned above. The CPU 301 detects, through the external interface 304, whether a finishing processing unit has been connected.

Figure 4:
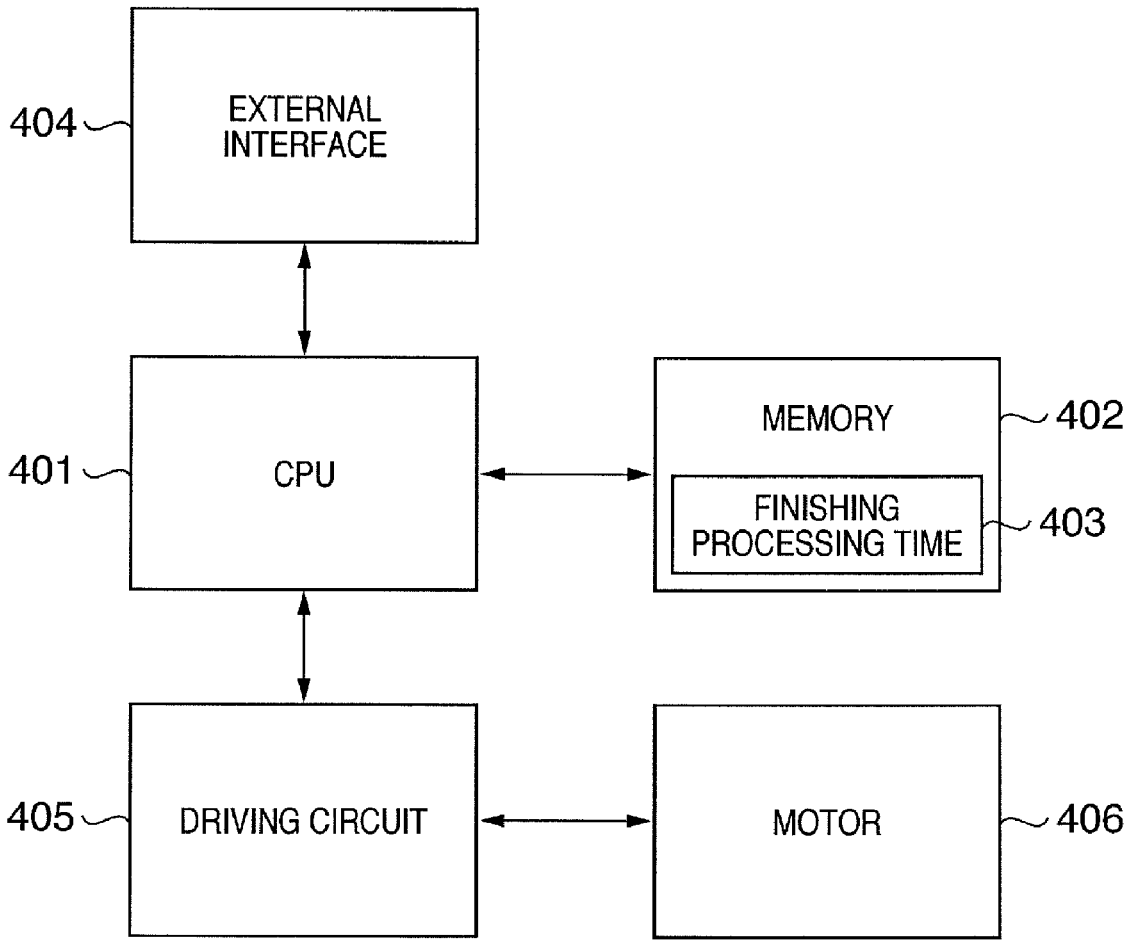
FIG. 4 is an exemplary block diagram illustrating the controller of a finishing processing unit according to the embodiment.

FIG. 4 is an exemplary block diagram illustrating the controller of a finishing processing unit according to the embodiment. A controller 400 of the finishing processing units 201 to 204 includes a CPU 401, a memory 402, an external interface 404, a driving circuit 405 and a motor 406, etc. The CPU 401 controls finishing processing, etc., based upon a control that has been stored in the memory 402, etc. The memory 402, which is constituted by a RAM or ROM, etc., stores required information such as data 403 indicative of processing time necessary to execute finishing processing. The driving circuit 405 drives the motor 406 in accordance with instructions from the CPU 405. The motor 406 moves the above-described stapling unit to execute stapling processing.

Figure 5:
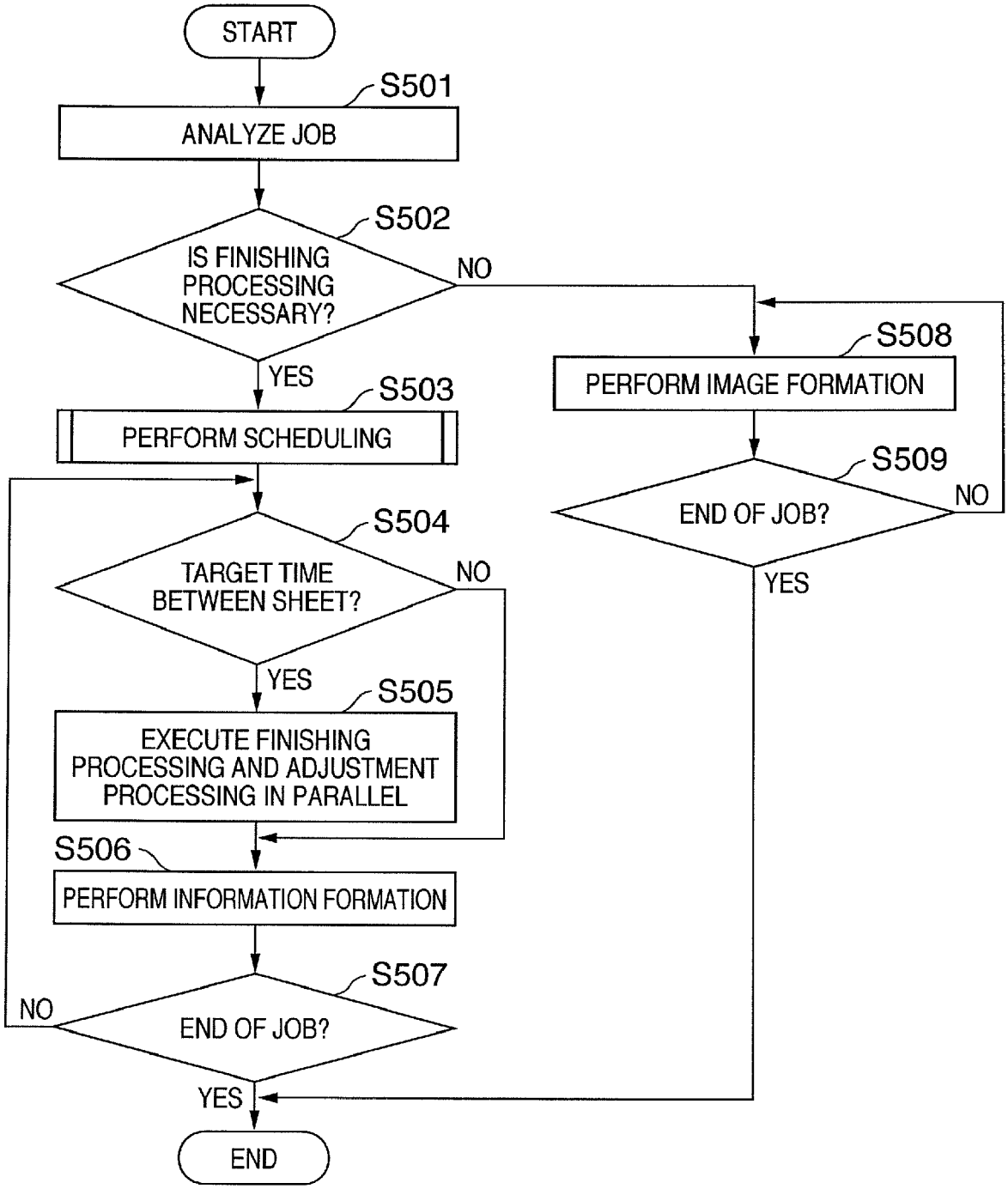
FIG. 5 is an exemplary flowchart illustrating adjustment processing and finishing processing executed in parallel according to this embodiment.

FIG. 5 is an exemplary flowchart illustrating adjustment processing and finishing processing executed in parallel according to this embodiment. According to this flowchart, adjustment processing for maintaining image quality is executed in the image forming unit 120 in parallel with execution of finishing processing applied to printing paper in the finishing processing unit. It should be noted that the image formation interval may be lengthened in accordance with the processing time necessary to execute finishing processing.

The CPU 301 of the printer controller 170 analyzes the generated job at step S501. The CPU 301 investigates whether the job contains a page requiring finishing processing. For example, if the job is one in which stapling is to be performed in the single-sided printing of five pages, then finishing processing that is stapling processing is required. It should be noted that the timing between sheets at which finishing processing is to be executed also is found by analyzing the job. For example, if the job is one in which six copies are to be created of five pages of single-sided printing, the break between copies becomes the timing between sheets at which finishing processing is to be executed. If punch processing has been designated, then the timing between sheets at which finishing processing is to be executed is not the break between copies but is the time between all sheets. However, if there is another puncher that does not cause the printing paper to be stopped, then this need not be taken into consideration as finishing processing.

At step S502, the CPU 301 determines whether finishing processing is necessary. If finishing processing is unnecessary, control proceeds to step S508, where the CPU 301 sets the time between sheets to the minimum and executes the job as is. This is followed by step S509, at which the CPU 301 determines whether the job has ended. If the job has not ended, then control returns to step S508. If the job has ended, processing relating to this flowchart is exited in its entirety.

If it is found at step S502 that finishing processing is necessary, then control proceeds to step S503. Here the CPU 301 performs scheduling so as to execute correction processing within the time between sheets assured in order to execute finishing processing.

Next, at step S504, the CPU 301 determines whether the present time between sheets is the time between sheets (referred to as the "target time between sheets") that has been scheduled so as to execute finishing processing. If the present time between sheets is not the target time between sheets, control proceeds to step S506. If the present time between sheets is the target time between sheets, however, control proceeds to step S505. Here the CPU 301 exercises control in such a manner that the finishing and adjustment processes are executed in parallel.

It is assumed that the time between sheets is set in such a manner that the finishing and adjustment processes can be executed satisfactorily in parallel. Accordingly, there are cases where the time between sheets that has been set is minimum time $T_{min}$ between sheets and cases where it is a time obtained by lengthening the minimum time between sheets by T□.

It should be noted that the CPU 301 transmits a finishing-processing executable instruction to the CPU 401 of the finishing processing unit that has been selected from among the finishing processing units 201 to 204. The CPU 401 executes finishing processing in accordance with the executable instruction received.

At step S506, the CPU 301 controls the image forming unit 120 so as to execute image formation with respect to the next sheet of printing paper.

Next, at step S507, the CPU 301 determines whether the job has ended. If the job has not ended, control returns to step S504. If the job has ended, then processing relating to this flowchart is exited in its entirety.

In accordance with this embodiment, as described above, downtime can be diminished by executing adjustment processing, which is for maintaining image quality, in parallel with finishing processing.

Further, in the image forming unit 120, the CPU 301 performs scheduling so as to execute adjustment processing within the time between sheets (the time between a first sheet of printing paper and a second sheet of printing paper) assured in order to execute finishing processing. In other words, scheduling is performed so as to execute adjustment processing in the period from the end of formation of an image, which is to transferred to the first sheet of printing paper, on the photosensitive drum 122 to the start of formation of an image, which is to be transferred to the second sheet of printing paper, on the photosensitive drum 122. As a result, the time between sheets, which was originally made longer than the minimum time between sheets in order to execute finishing processing, can be exploited effectively as time for adjustment processing.

Figure 6:
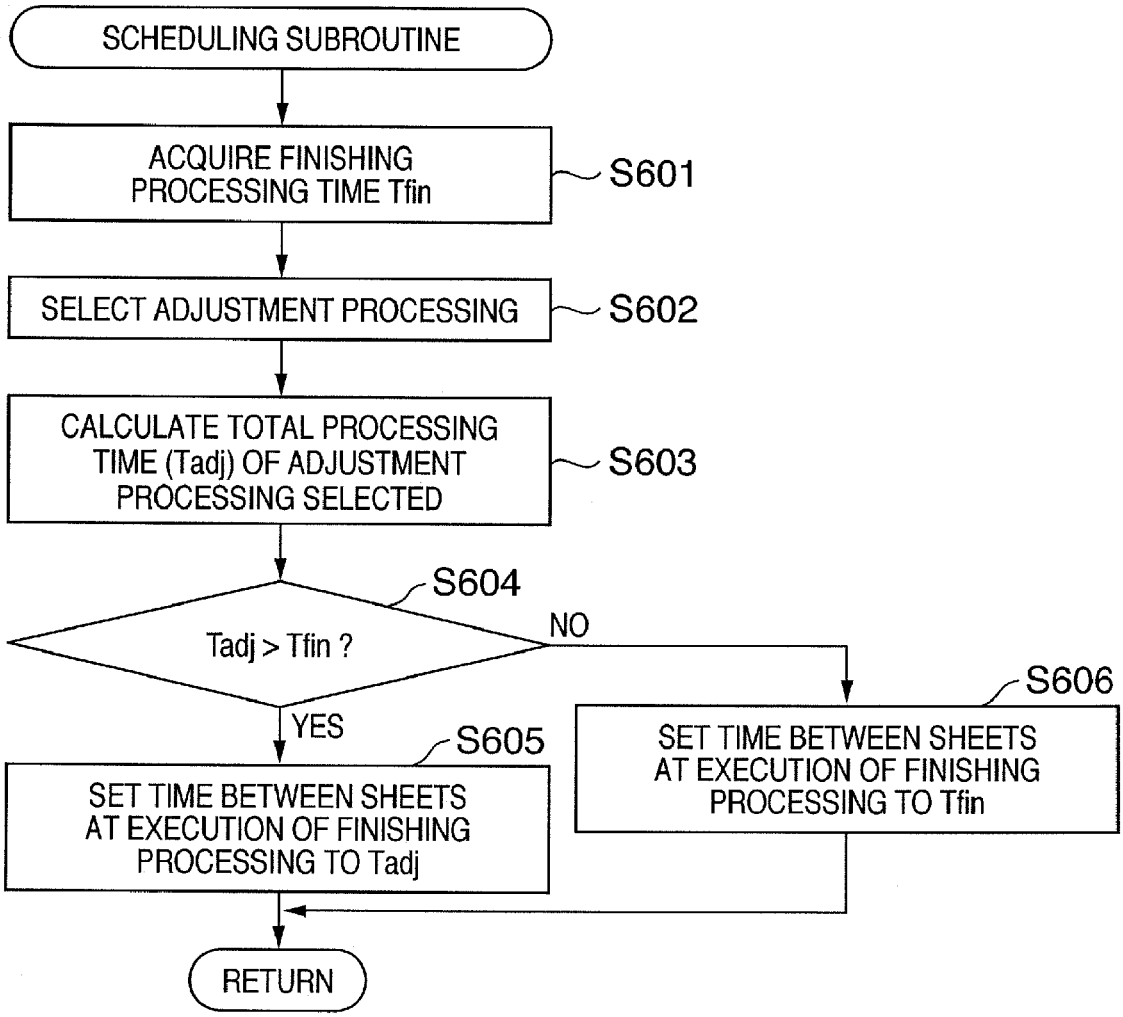
FIG. 6 is an exemplary flowchart illustrating the scheduling of finishing processing and adjustment processing according to the embodiment.

FIG. 6 is an exemplary flowchart illustrating the scheduling of finishing processing and adjustment processing according to the embodiment. This scheduling subroutine corresponds to step S503 described above.

At step S601 in FIG. 6, the CPU 301 of the printer controller 170 queries the CPU 401 of the finishing processing units 201 to 204 with regard to a processing time $T_{fin}$ that is necessary in order to execute finishing processing. The CPU 401 reads the processing-time data 403 out of the memory 402 and transmits this data to the CPU 301.

At step S602, the CPU 301 selects the adjustment processing necessary to be executed during the image formation job. For example, taking into consideration the time processing was executed last or the number of images formed since the last execution of processing, the CPU 301 selects the adjustment processing to be executed now from among the various adjustment processes mentioned above. Depending upon the conditions, a case where there is no adjustment processing to be executed is also possible. Further, in a case where timing at which adjustment processing is to be executed is ideally somewhat later than the timing of finishing processing (e.g., five sheets later), adjustment processing is speeded up and made to conform to the timing of finishing processing. Similarly, in a case where timing at which adjustment processing is to be executed is ideally somewhat earlier than the timing of finishing processing (e.g., two sheets earlier), adjustment processing is slowed down and made to conform to the timing of finishing processing.

At step S603, the CPU 301 calculates the total ($T_{adj}$) processing time of the adjustment processing selected.

At step S604, the CPU 401 compares the total processing time $T_{adj}$ needed for adjustment processing with processing time $T_{fin}$ needed for finishing processing. If the total processing time $T_{adj}$ needed for adjustment processing is longer than the processing time $T_{fin}$ needed for finishing processing ("YES" at step S604), control proceeds to step S605. Here the CPU 301 sets the time between sheets for when finishing processing is executed to $T_{adj}$. On the other hand, if the total processing time $T_{adj}$ needed for adjustment processing is equal to or shorter than the processing time $T_{fin}$ needed for finishing processing ("NO" at step S604), then control proceeds to step S606, where the CPU 301 sets the time between sheets for when finishing processing is executed to $T_{fin}$.

In accordance with this embodiment, as described above, it is so arranged that if data representing processing time for executing finishing processing has not been ascertained by the printer controller 170, then this data is acquired from the finishing processing unit. In general, since the processing unit is an optional product that can be removably attached to the main body of the image forming apparatus, there are cases where the unit is designed later than the main body of the image forming apparatus. If data relating to processing time is held on the side of the finishing processing unit in advance, this is convenient because it raises the degree of freedom of design with respect to the finishing processing unit.

Furthermore, since the CPU 301 assures a time between sheets in conformity with whichever is the longer of processing time for executing finishing processing or processing time for executing adjustment processing, both types of processing can be executed appropriately. This makes it possible to avoid an inconvenience in which formation of the next image starts irrespective of the fact that either type of processing has not ended.

[When Finishing Processing Unit has not been Connected]

There are also cases where a finishing processing unit that is removably attached to the main body of the image forming apparatus has not been connected to the main body. If the finishing processing unit has not been connected, adjustment processing cannot be executed in parallel with finishing processing. Basically, therefore, image formation is executed at peak throughput (at the minimum time between sheets or at minimum distance between sheets).

Figure 7:
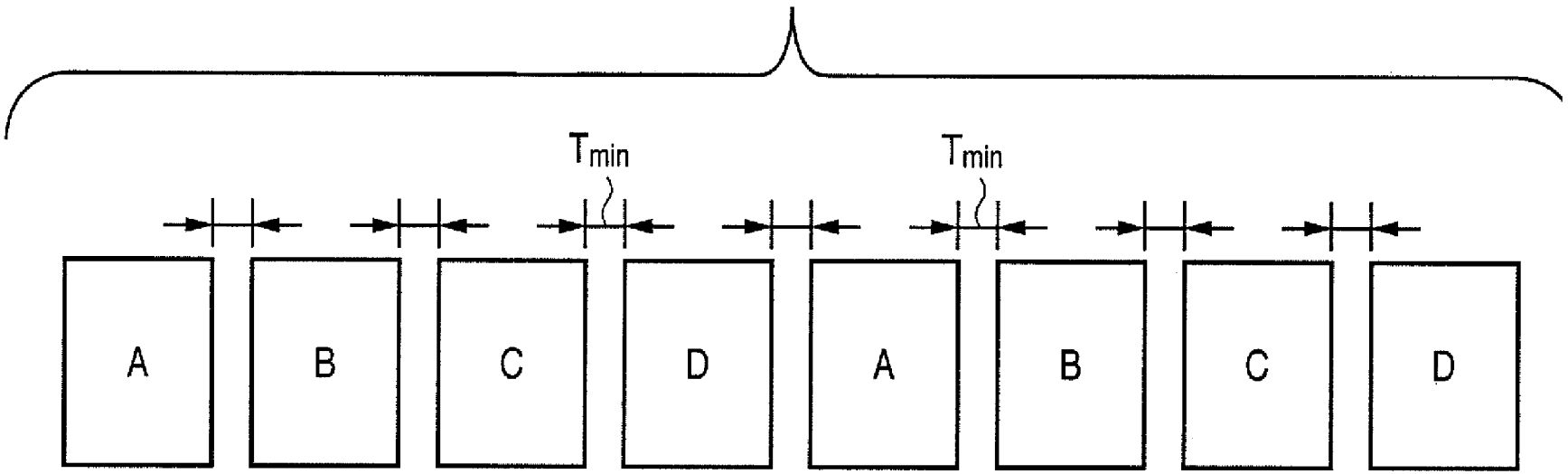
FIG. 7 is a diagram illustrating images formed on an image carrier according to the embodiment.

FIG. 7 is a diagram illustrating images formed on an image carrier according to the embodiment. It will be understood from FIG. 7 that the time between images formed on the intermediate transfer medium 125 is the minimum time $T_{min}$ between sheets. Although control may be exercised so as to execute adjustment processing capable of being executed within the minimum time $T_{min}$ between sheets, almost no such adjustment processing exists. From the standpoint of maintaining image quality, it goes without saying that adjustment processing preferably be executed even during the performance of a job. In principle, therefore, image formation is performed in the minimum time between sheets and adjustment processing may be executed while assuring time between sheets as necessary.

Figure 8:
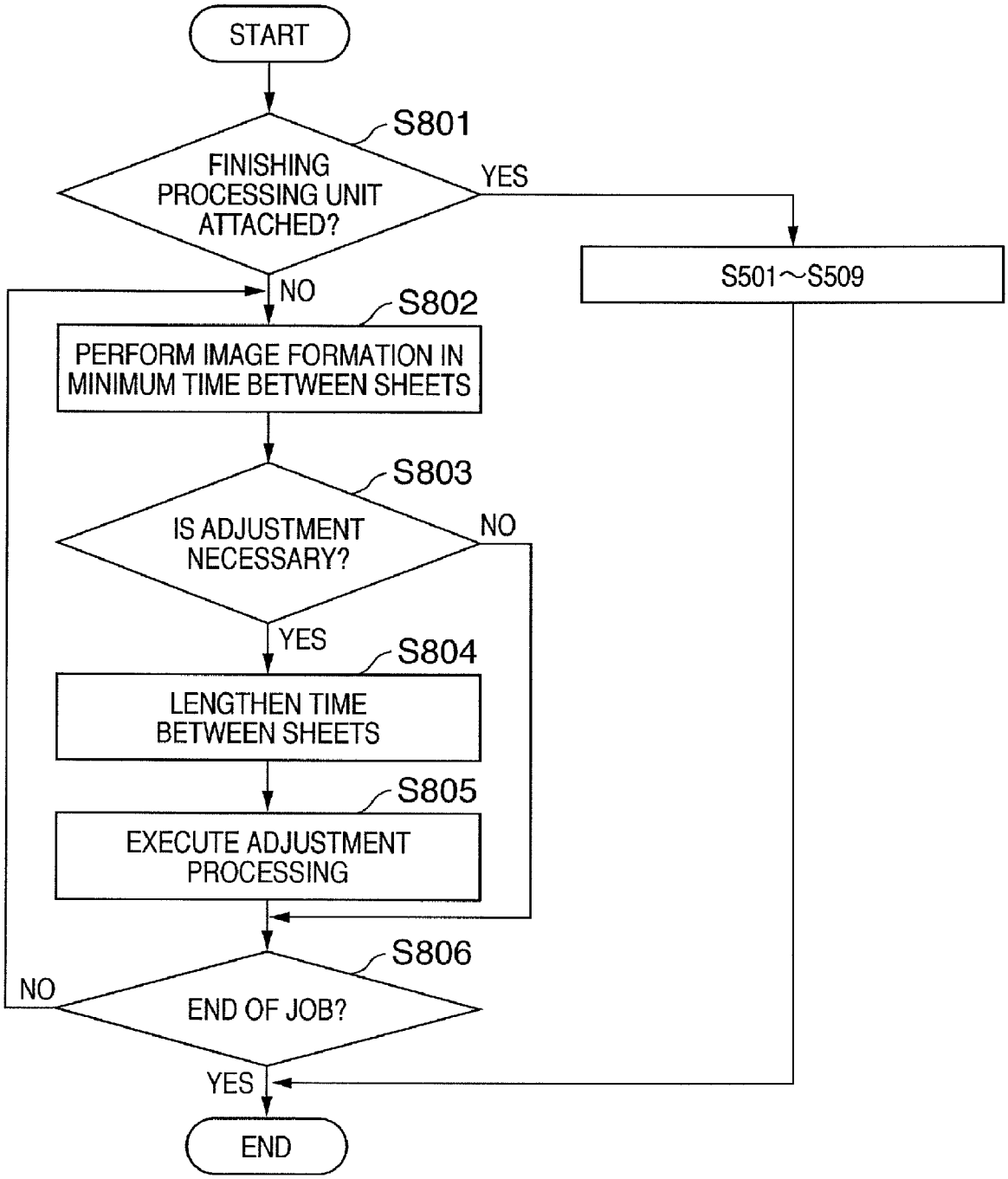
FIG. 8 is an exemplary flowchart illustrating adjustment processing and finishing processing executed in parallel according to this embodiment.

FIG. 8 is an exemplary flowchart illustrating adjustment processing and finishing processing executed in parallel according to this embodiment.

At step S801, the CPU 301 determines whether a removably attachable finishing processing unit could be attached. For example, the CPU 301 is capable of detecting that the finishing processing unit has been attached by communicating with the finishing processing unit through the external interface 304. Alternatively, this can also be detected by a switch-type sensor that turns ON when the finishing processing unit is attached and turns OFF when the finishing processing unit is detached.

If attachment of the finishing processing unit could be detected, steps S501 to S509 described above are executed. If attachment of the finishing processing unit could not be detected, on the other hand, then control proceeds to step S802, where the CPU 301 executes image formation at the minimum time between sheets (minimum distance between sheets).

This is followed by step S803, at which the CPU 301 determines whether an adjustment-processing execute request has been issued during image formation. If the execute request has been issued, control proceeds to step S804, where the CPU 301 lengthens the time between sheets in order to execute adjustment processing.

The CPU 301 executes adjustment processing within the lengthened time between sheets at step S805.

Next, at step S806, the CPU 301 determines whether the job has ended. Control returns to step S802 if the job has not ended, and processing relating to this flowchart is exited in its entirety if the job has ended.

In accordance with this embodiment, adjustment processing can be executed in parallel with finishing processing if the finishing processing unit has been attached. This makes it possible to reduce the occurrence of downtime. If the finishing processing unit has not been attached, on the other hand, then the minimum time between sheets is lengthened temporarily and adjustment processing is executed. As a result, image quality can be maintained while an increase in downtime is suppressed.

The existence of operators who are especially concerned about downtime during a job also is a possibility. In order to diminish downtime when a finishing processing unit has not been attached, adjustment processing during image formation may inhibited entirely. That is, steps S803 to S805 may be eliminated entirely.

It should be noted that even in this case, a preparatory period for the image forming apparatus exists before the initial job starts. So-called "pre-rotation processing" is executed in the preparatory period. When all jobs are finished, so-called "post-rotation processing" is executed.

When image formation is not being carried out during execution of pre-rotation or post-rotation processing, the CPU 301 may exercise control in such a manner that adjustment processing is executed. This would make it possible to maintain the minimum required image quality.

[When Ten Small-Size Prints are Created, these are Stapled and Ten Copies are Discharged into One Tray]

Figure 9:
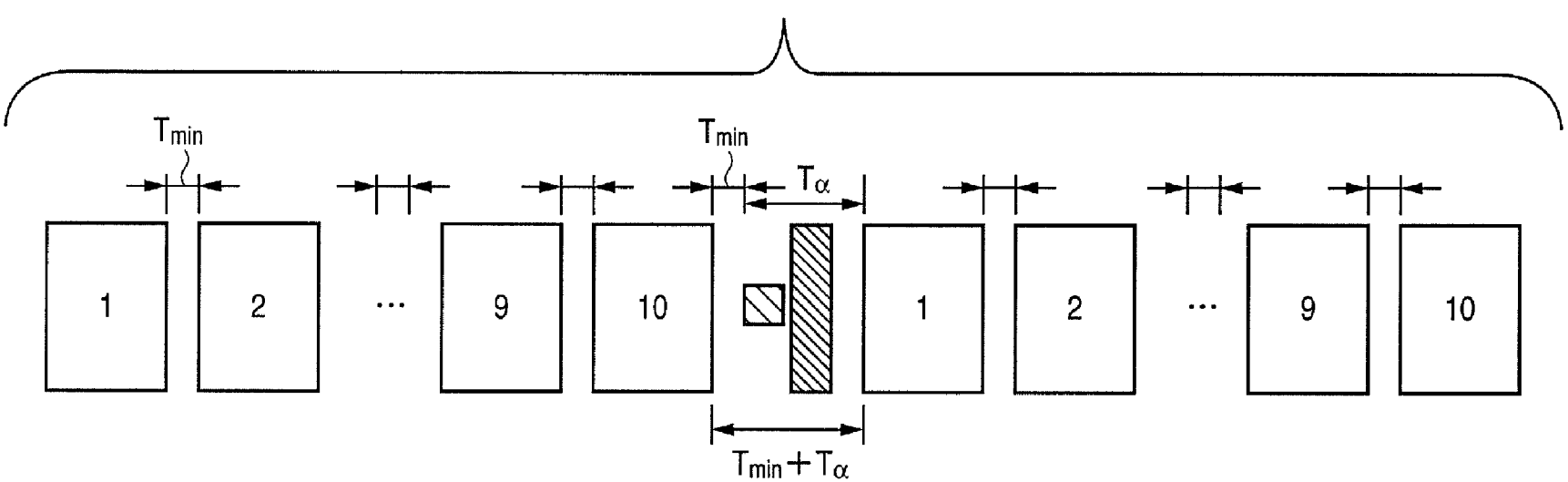
FIG. 9 is a diagram illustrating an example in which time between sheets is lengthened in accordance with finishing processing time.

FIG. 9 is a diagram illustrating an example in which time between sheets is lengthened in accordance with finishing processing time. When finishing processing such as stapling is executed in a finishing processing unit, the timing of the next image forming operation is prolonged by the timing at which finishing processing (stapling) is to be executed. That is, the time (distance) between sheets is lengthened.

In accordance with FIG. 9, time $T_{min}+T\alpha$ between sheets is assured by the CPU 301 when image formation has ended with regard to ten small-size print images. That is, the time between sheets is made longer than the minimum time $T_{min}$ between sheets by $T\alpha$, where $T\alpha$ represents stapling processing time. The time $T_{min}+T\alpha$ between sheets is long in comparison with the minimum time between sheets in a case where no finishing processing whatsoever is executed. At step S601, therefore, the CPU 301 is capable of selecting and executing adjustment processing that cannot be executed within the minimum time between sheets.

In the example illustrated in FIG. 9, patch detection is executed utilizing the vicinity at the center of an area of the intermediate transfer medium 125 corresponding to a wide spacing between sheets immediately after image formation ends with regard to the initial then images. This may then be followed by implementing black band control using all areas of main-scan width.

[When Ten Large-Size Prints are Folded in Half, these are Stapled and Ten Copies are Discharged into the Saddle Tray]

Figure 10:
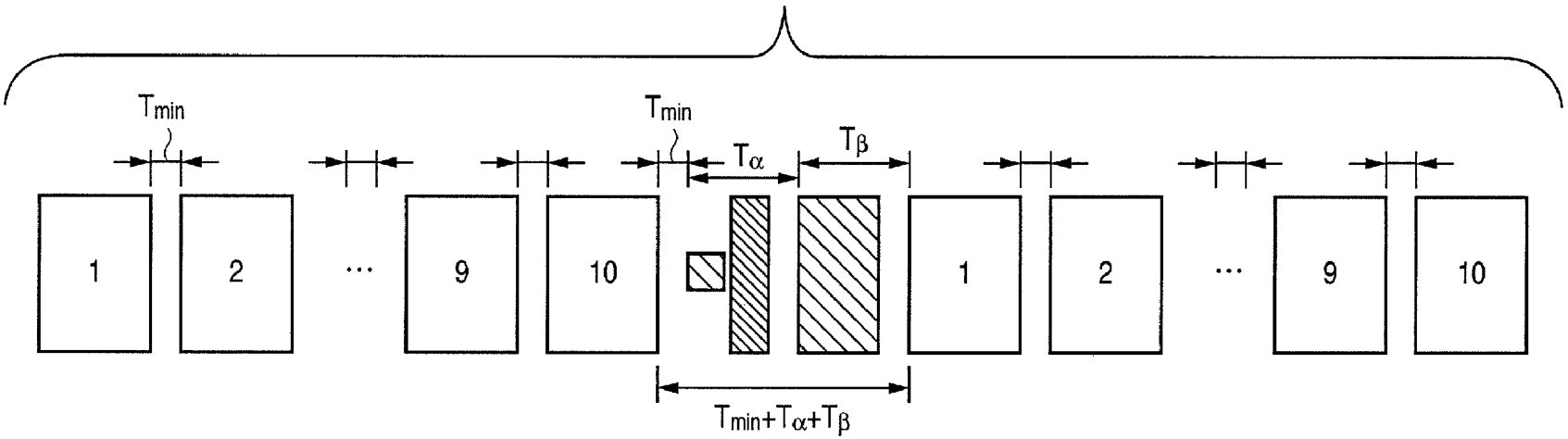
FIG. 10 is a diagram illustrating another example in which time between sheets is lengthened in accordance with finishing processing time.

FIG. 10 is a diagram illustrating another example in which time between sheets is lengthened in accordance with finishing processing time. In comparison with the example shown in FIG. 9, time between sheets is lengthened further by an amount needed for execution of folding as the finishing processing.

At step S601, therefore, the CPU 301 is capable of selecting adjustment processing having a long processing time or a number of adjustment processes. For example, the CPU 301 can select secondary-transfer ATVC in addition to patch detection and black band control.

It should be noted that the total processing time $T_{adj}$ needed in order to execute three adjustment processes is longer than the processing time $T_{fin}$ of finishing processing (saddle processing) (step S604). Consequently, the time between sheets is lengthened by the processing time $T\beta$ of secondary-transfer ATVC (step S605).

In the example illustrated in FIG. 10, the total processing time of adjustment processing executed during the image forming job is becomes longer as a result. However, executing these adjustment processes collectively rather than splitting them up and executing them individually is preferred in terms of facilitating a reduction in downtime. The reason for this is that when software in particular is executed, the labor involved in executing communication processing housekeeping repeatedly is eliminated.

Other Embodiments

Above embodiments directs to parallel execution of various finishing processes and various adjustment processes in at least one job. However, there would be cases where a plurality of jobs are linked but each of the jobs is directed to different discharge trays. In this case, tray shift processing would be necessary.

Figure 11:
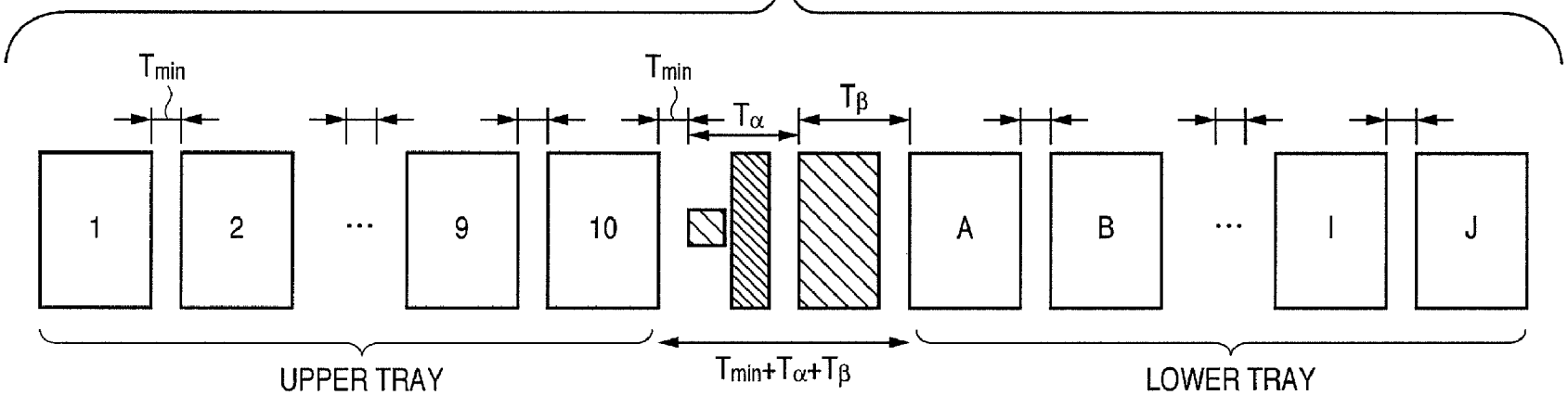
FIG. 11 is a diagram illustrating a further example in which time between sheets is lengthened in accordance with finishing processing time.

FIG. 11 is a diagram illustrating a further example in which time between sheets is lengthened in accordance with finishing processing time. In accordance with the example illustrated in FIG. 11, a first half of ten print images is discharged into an upper tray of discharge trays 204, and a second half of ten print images is discharged into a lower tray of discharge trays 204.

Such a job requires a processing time for shifting the tray up and down at the break in the job. Further, the CPU 301 is capable of ascertaining the break. Accordingly, patch detection, black band control and secondary-transfer ATVC are executed successively in parallel with the shift processing in the break of the job.

There are instances where the discharge tray of the finishing processing unit becomes full with a batch of sheets of printing paper. A tray shift is performed in this case as well. Accordingly, at the moment a full tray is sensed, the CPU 301 may execute processing to raise or lower the tray and the appropriate adjustment processing in parallel.

Further, the image forming apparatus also executes adjustment processing for forming a test pattern for every developed color for the purpose of a grayscale correction, measuring the density of the test pattern formed and adjusting a $\gamma$ table (density correction characteristic) based upon results of measurement and target density. It can be so arranged that the adjustment processing for this grayscale correction also is made to conform to the execution timing of finishing processing.

The present invention can be applied to a system constituted by a plurality of devices, or to an apparatus comprising a single device. Furthermore, it goes without saying that the invention is applicable also to a case where the object of the invention is attained by supplying a program to a system or apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-235484, filed on Aug. 15, 2005, which is hereby incorporated by reference herein in its entirety.

What is claimed is:

1. An apparatus for forming images, comprising:

an image forming unit which forms an image on a recording medium and transfers the image on the recording medium to a sheet;

a finishing processing unit which applies finishing processing to the sheet, which has been transported from said image forming unit;

a setting unit which sets a time between sheets in accordance with finishing processing to be executed, the time between sheets being a period of time from end of image formation of an image to be transferred to a first sheet to start of image formation of an image to be transferred to a second sheet following the first sheet, the end of image formation being associated with a timing for executing the finishing processing; and a controller which determines, based on the time between sheets set by said setting unit, an adjusting processing regarding image quality to be started during the period of time from the end of the image formation of the image to be transferred to the first sheet to the start of the image formation of the image to be transferred to the second sheet, and executes the determined adjusting processing during the period of time;

wherein said setting unit sets the time between sheets based on the longer one of processing time required for executing the finishing processing and processing time required for executing the determined adjustment processing.

2. The apparatus according to claim 1, wherein said setting unit acquires information concerning processing time, which is for executing the finishing processing, from said finishing processing unit.

3. The apparatus according to claim 1, wherein said controller causes the adjustment processing to be executed independently of the finishing processing if a request to execute the adjustment processing has been issued when an imaging forming job is not being executed in said image forming unit.

* * * * *